US006979216B2

(12) United States Patent
Maeda et al.

(10) Patent No.: US 6,979,216 B2
(45) Date of Patent: Dec. 27, 2005

(54) ELECTRICAL CONNECTOR HAVING A MECHANISM FOR SUPPLEMENTING SPRING CHARACTERISTICS OF A CONTACT

(75) Inventors: Toshihiko Maeda, Tokyo (JP); Isao Takahashi, Tokyo (JP)

(73) Assignees: Japan Aviation Electronics Industry, Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 10/843,779

(22) Filed: May 12, 2004

(65) Prior Publication Data

US 2004/0229491 A1 Nov. 18, 2004

(30) Foreign Application Priority Data

May 13, 2003 (JP) ..... 2003-134207

(51) Int. Cl.[7] ..... H01R 13/15
(52) U.S. Cl. ..... 439/260
(58) Field of Search ..... 439/260, 267, 439/635, 637, 755, 62

(56) References Cited

U.S. PATENT DOCUMENTS

| | | | | |
|---|---|---|---|---|
| 3,697,929 | A | | 10/1972 | Konewko et al. |
| 3,922,054 | A | * | 11/1975 | Dechelette ..... 439/260 |
| 4,560,221 | A | | 12/1985 | Olsson |
| 4,626,056 | A | | 12/1986 | Andrews, Jr. et al. |
| 4,629,270 | A | | 12/1986 | Andrews, Jr. et al. |
| 4,684,181 | A | | 8/1987 | Massit et al. |
| 4,720,156 | A | * | 1/1988 | Beers ..... 439/260 |
| 4,842,538 | A | | 6/1989 | Noschese |
| 4,864,729 | A | * | 9/1989 | Funger ..... 30/290 |
| 4,894,022 | A | * | 1/1990 | Guckenheimer ..... 439/260 |
| 5,205,739 | A | | 4/1993 | Malo et al. |
| 5,273,450 | A | | 12/1993 | Renn et al. |
| 5,316,486 | A | * | 5/1994 | Tanaka et al. ..... 439/62 |
| 5,564,931 | A | * | 10/1996 | Fabian et al. ..... 439/62 |
| 5,795,171 | A | * | 8/1998 | Bernardini ..... 439/260 |
| 6,036,519 | A | * | 3/2000 | Lopata et al. ..... 439/260 |
| 6,368,129 | B1 | * | 4/2002 | Wang et al. ..... 439/260 |
| 6,824,410 | B1 | * | 11/2004 | Co et al. ..... 439/260 |
| 2002/0028588 | A1 | | 3/2002 | Watanabe et al. |

FOREIGN PATENT DOCUMENTS

JP 6196230 7/1994

* cited by examiner

*Primary Examiner*—Ross Gushi
*Assistant Examiner*—Phuongchi Nguyen
(74) *Attorney, Agent, or Firm*—Collard & Roe, P.C.

(57) ABSTRACT

In a connector comprising a housing (11) and a contact (21) held by the housing, the contact is brought into contact with a connection object under a pressing force obtained by operating an operating member (61). An elastic member (71) elastically deformable is interposed between the contact and the operating member. The operating member has a first cam surface **(63*a*) for applying the pressing force to the contact with elastic deformation of the elastic member and a second cam surface (63*b*) for releasing the pressing force. An insulating actuator (51)** cooperating with the contact may be interposed between the contact and the elastic member. The elastic member may be a leaf spring member held by the actuator.

15 Claims, 6 Drawing Sheets

ELECTRICAL CONNECTOR HAVING A MECHANISM FOR SUPPLEMENTING SPRING CHARACTERISTICS OF A CONTACT

This invention claims priority to prior Japanese patent application JP 2003-134207, the disclosure of which is incorporated herein by reference.

BACKGROUND OF THE INVENTION

This invention relates to an electrical connector for connecting a substrate as a mother board and a connection object as a daughter board.

For example, Japanese Patent Application Publication (JP-A) No. H6-196230 (corresponding to U.S. Pat. No. 5,273,450) discloses an electrical connector for connecting a mother board and a daughter board. The electrical connector comprises a connector body mounted on the mother board, and a compressible connector element carried by the connector body. The daughter board is inserted into the connector body and disposed to be substantially perpendicular to the mother board. The daughter board is provided with a circuit element to be electrically connected to the connector element. The connector element is used as a contact for electrically connecting the mother board and the daughter board to each other.

In recent years, the electrical connector of the type is required to be reduced in size. However, if the electrical connector is reduced in size, the contact is also miniaturized. It is therefore difficult to provide the contact with sufficient spring characteristics. This results in permanent deformation of the contact or insufficiency in contact force, thereby decreasing a contact reliability.

SUMMARY OF THE INVENTION

It is therefore an object of this invention to provide an electrical connector which is capable of supplementing spring characteristics of a contact so as to improve a contact reliability of the contact even if the contact is reduced in size.

It is another object of this invention to provide an electrical connector which is easy to make design change for adjusting spring characteristics of a contact and to carry out replacement of parts.

According to this invention, there is provided an electrical connector comprising an insulating housing, a conductive contact held by the housing, an operating member for applying a pressing force to the contact to bring the contact into contact with a connection object, and an elastic member elastically deformable and interposed between the operating member and the contact.

DESCRIPTION OF THE PREFERRED EMBODIMENT

Figure 1:
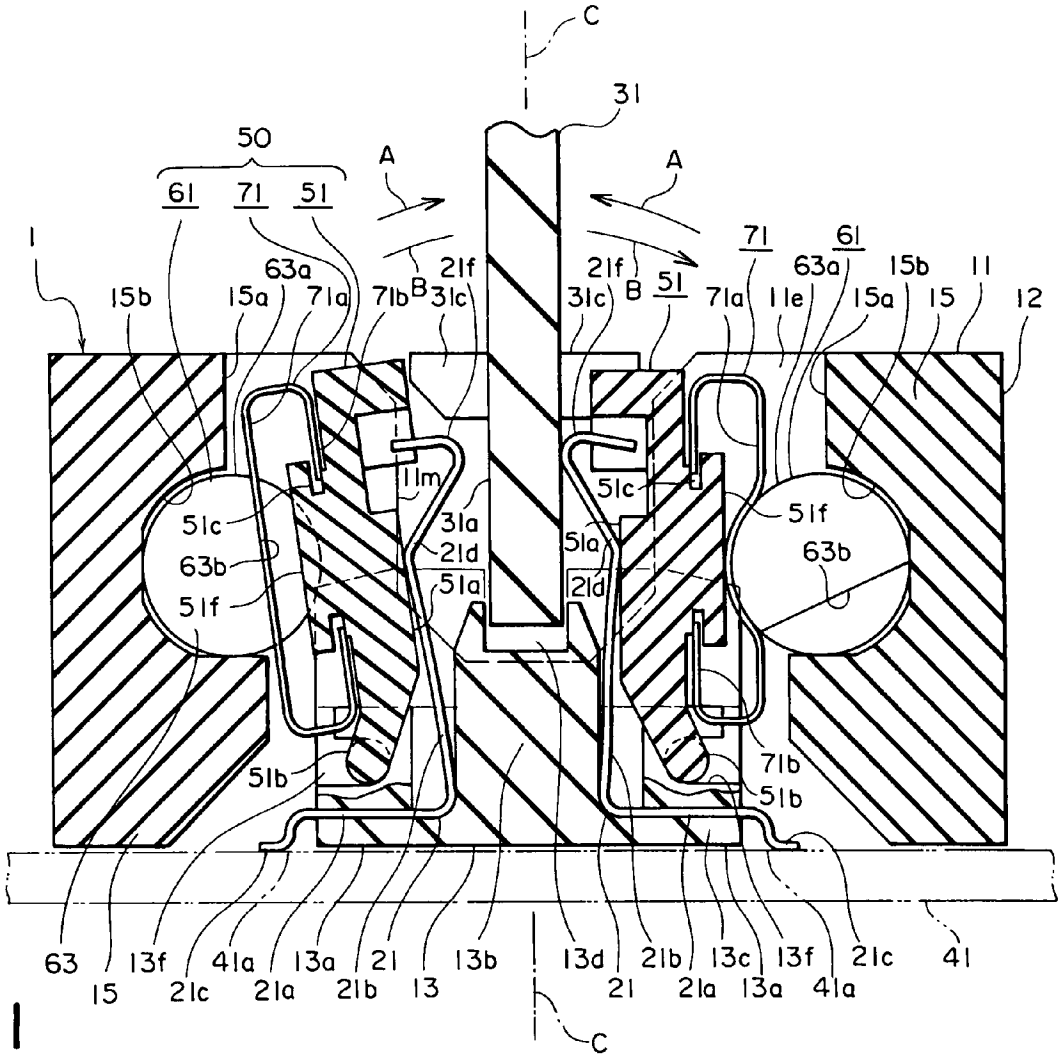
FIG. 1 is a sectional view of an electrical connector according to one embodiment of this invention together with a connection object.
Figure 2:
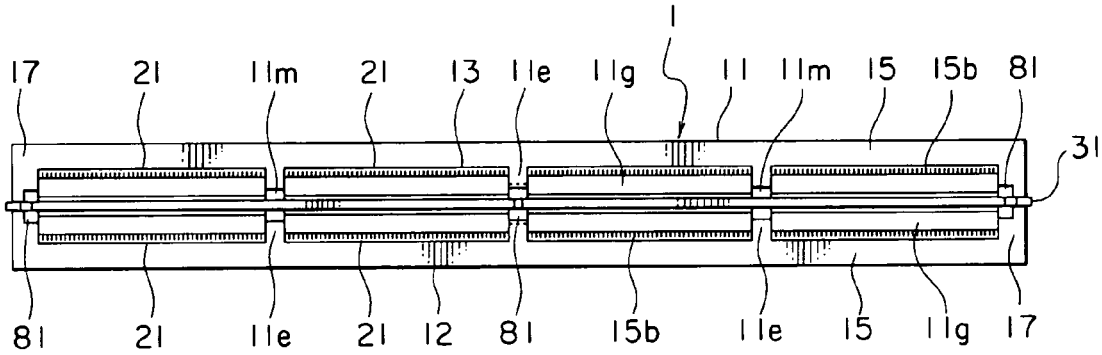
FIG. 2 is a plan view of the electrical connector illustrated in FIG. 1.
Figure 3:
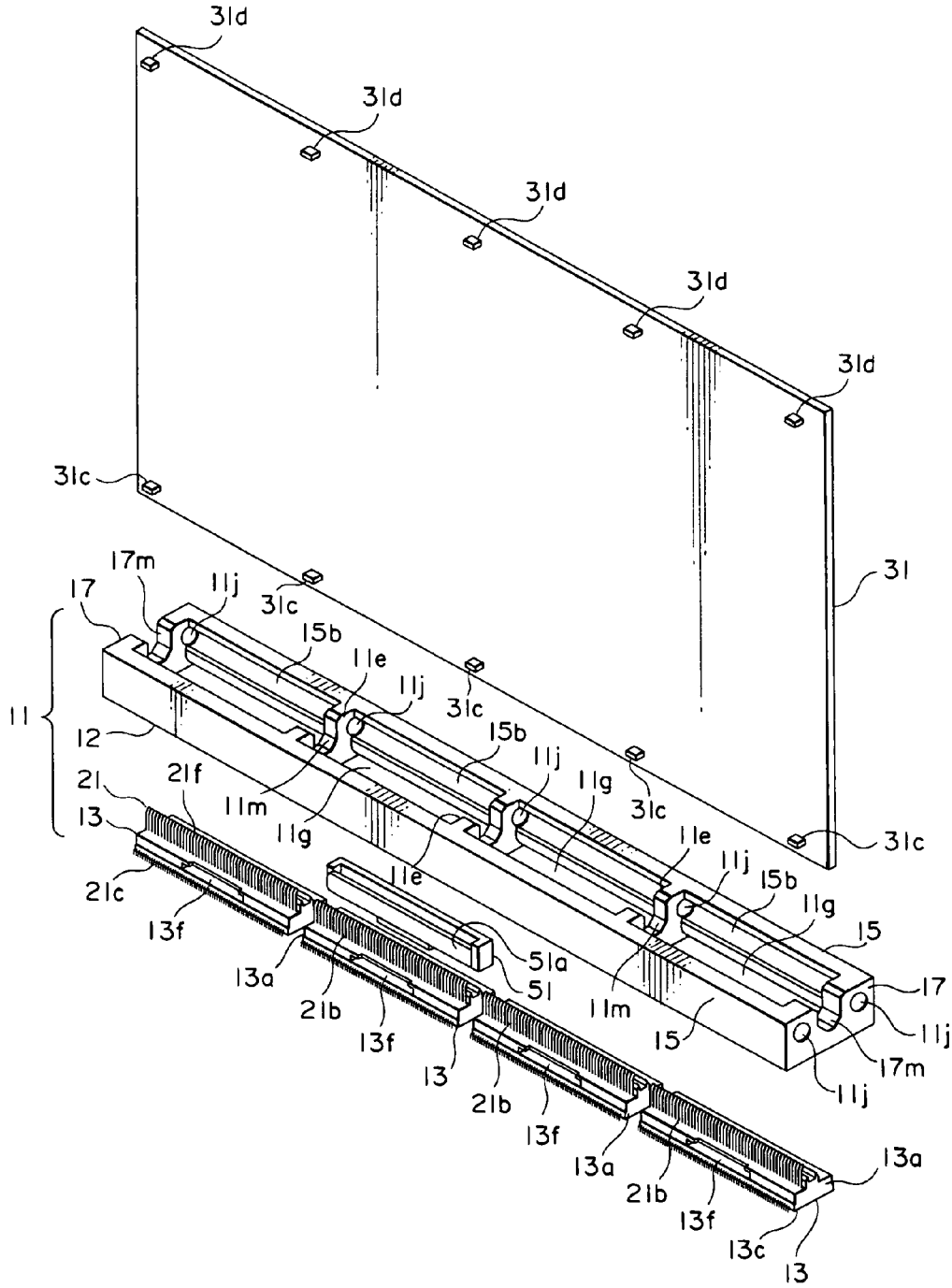
FIG. 3 is an exploded perspective view of the electrical connector illustrated in FIG. 1 together with the connection object.

Referring to FIGS. 1 through 3, description will be made of an electrical connector according to one embodiment of this invention.

The electrical connector 1 illustrated in the figure is generally called a card-edge electrical connector and comprises an insulating housing 11, a plurality of conductive contacts 21 disposed within the housing 11, and a plurality of contact moving mechanisms 50 coupled to the housing 11.

The housing 11 comprises a frame member 12 and a plurality of (four in the illustrated example) header members 13 fixed to the frame member 12 and aligned in a single line. The frame member 12 has a pair of first frame portions 15 extending in a longitudinal direction of the housing 11 and facing the header members 13 with a space kept therefrom in a transversal direction of the housing 11, and a pair of second frame portions 17 connecting longitudinal opposite ends of the first frame portions 15. Thus, a combination of the first and the second frame portions 15 and 17 surrounds the header members 13.

Each of the header members 13 has a header base portion 13*a* mounted on a base board 41 as a mother board, such as a printed circuit board, a header holding portion 13*b* extending from a center of the header base portion 13*a* upward in a vertical direction, and a pair of contact holding portions 13*c* formed integral on left and right sides of the header base portion 13*a*, respectively. The header holding portion 13*b* has an upper surface provided with an object receiving portion 13*d* for receiving an end portion of a connection object 31 as a daughter board, such as a printed circuit board, and holding the connection object 31 in the vertical direction. In FIG. 1, the vertical direction is a direction perpendicular to a center line C.

Each of the header members 13 has a pair of bearing portions 13*f* formed as grooves. The bearing portions 13*f* are positioned on left and right sides of the header base portion 13*a* above the contact holding portions 13*c*.

In FIG. 1, the contacts 21 and the contact moving mechanisms 50 are provided on left and right sides of a virtual plane containing the center line C and perpendicular to a drawing sheet, respectively. Each of the contacts 21 has a holding portion 21*a* held by the contact holding portion 13*c*, a contact spring portion 21*b* extending upward from one end of the holding portion 21*a*, and a terminal portion 21*c* extending outward from the contact holding portion 13*c*. The contact spring portion 21*b* extends upward from the one end of the holding portion 21*a* along each of a pair of vertical side surfaces of the header holding portion 13*b*.

As will later become clear, each of the contact moving mechanisms 50 serves to move each of the contacts 21 in a first direction A (FIG. 1) to bring the contact 21 into contact with the connection object 31 and to move the contact 21 in a second direction B (FIG. 1) opposite to the first direction A to separate the contact 21 from the connection object 31.

Thus, the contact 21 is moved by the contact moving mechanism 50 between a contact position and a non-contact position where the contact 21 is in contact with and out of contact from the connection object 31, respectively.

Figure 4:
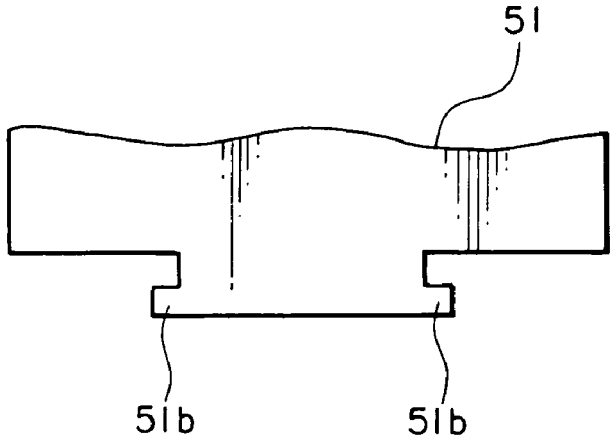
FIG. 4 is a front view showing a shaft portion of an actuator of the electrical connector illustrated in FIG. 1.
Figure 5:
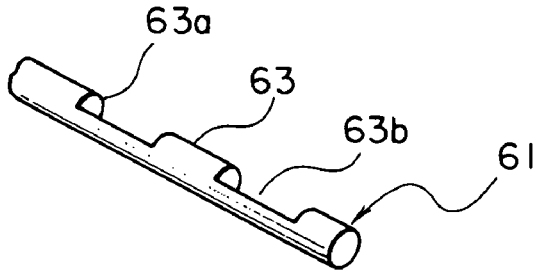
FIG. 5 is a perspective view showing a cam portion of an operating member of the electrical connector illustrated in FIG. 1.

Referring to FIGS. 4 and 5 in addition to FIGS. 1 through 3, each of the contact moving mechanisms 50 will be described.

As shown in FIG. 1, the contact moving mechanism 50 comprises an actuator 51 held by the bearing portion 13*f*, an operating member 61 located at a predetermined position on an inner wall surface 15*a* of the first frame portion 15 to move the actuator 51, and an elastic member, i.e., an auxiliary spring member 71 elastically deformable and interposed between the actuator 51 and the operating member 61. The auxiliary spring member 71 is a leaf spring formed by bending a band-like spring material into a generally rectangular cylindrical shape.

The first frame members 15, the contacts 21, the actuators 51, the operating members 61, and the auxiliary spring members 71 are disposed symmetrical with respect to the above-mentioned virtual plane. Each of the actuators 51 has a pressing portion 51*a* to be brought into contact with the contact spring portion 21*b* of the contact 21, and a cylindrical shaft portion 51*b* removably engaged with the bearing portion 13*f* of the header member 13 so that the actuator 51 is movable in the first and the second directions A and B.

The operating member 61 is held on the inner wall surface 15*a* of the first frame portion 15. The operating member 61 has a cam portion 63 for moving the actuator 51 in the first and the second directions A and B. The operating member 61 is kept in contact with the auxiliary spring member 71 so as to be rotatable in sliding contact with the auxiliary spring member 71.

The contact spring portion 21*b* of the contact 21 is provided with a butt portion 21*d* formed at its intermediate position and butted to the pressing portion 51*a* of the actuator 51. The butt portion 21*d* is slightly bent towards the pressing portion 51*a* so as to be butted to the pressing portion 51*a* of a flat shape. The contact spring portion 21*b* has a free end provided with a contact point 21*f* protruding towards the above-mentioned virtual plane to face the connection object 31.

The cam portion 63 has a first cam surface 63*a* for applying a pressing force to the auxiliary spring member 71 and a second cam surface 63*b* for releasing the pressing force upon the auxiliary spring member 71. The first cam surface 63*a* presses the auxiliary spring member 71 to move the actuator 51 in the first direction A. The second cam surface 63*b* releases the pressing force upon the auxiliary spring member 71 to allow the actuator 51 to move in the first direction B by a spring restoring force of the contact spring portion 21*b*.

The inner wall surface 15*a* of the first frame portion 15 is provided with a recess 15*b* having a cylindrical surface. The auxiliary spring member 71 has a deformable plate portion 71*a* facing the inner wall surface 15*a* of the first frame portion 15 and a pair of spring holding portions 71*b* extending from opposite ends of the deformable plate portion 71*a* and bent and folded back to face the deformable plate portion 71*a*. The spring holding portions 71*b* has end portions engaged with and held by a pair of spring receiving portions 51*c* formed on the actuator 51.

The first cam surface 63*a* is an outer peripheral surface having a cylindrical shape and adapted to be brought into contact with the deformable plate portion 71*a* of the auxiliary spring member 71. The second cam surface 63*b* is a flat surface formed by linearly cutting the first cam surface 63*a* in directions intersecting with each other. The recess 15*b* of the first frame portion 15 receives a part of the outer peripheral surface of the operating member 61, i.e., a part of the first cam surface 63*a*.

When the first cam surface 63*a* faces the auxiliary spring member 71, the auxiliary spring member 71 is pressed by the first cam surface 63*a* to move the actuator 51 in the first direction A. At this time, the contact spring portion 21*b* is energized or urged. On the other hand, when the second cam surface 63*b* faces the auxiliary spring member 71, the auxiliary spring member 71 is not substantially pressed and, as a consequence, the actuator 51 is moved in the second direction B under the restoring force of the contact spring portion 21*b*.

As best shown in FIGS. 2 and 3, a plurality of partition walls 11*e* are formed between the first frame portions 15 at predetermined intervals in the longitudinal direction of the housing 11 to define four chambers 11*g* in which the header members 13 are accommodated, respectively. Between the first frame portions 15, a space is left in the transversal direction of the housing 11 so that the actuator 51 and the auxiliary spring member 71 are movably accommodated in order to allow the contacts 21 held by the header member 13 to be moved and displaced.

For convenience of illustration, only one actuator 51 is shown in FIG. 3. However, each of the four header members 13 holds two actuators 51. Specifically, the shaft portion 51*b* of each of the actuators 51 is inserted into the bearing portion 13*f* of the header member 13 so that the actuator 51 is rotatable. Thus, each of the chambers 11*g* separated by the partition walls 11*e* accommodates one header member 13 provided with the contacts 21 and two actuators 51 provided with the auxiliary spring members 71.

The frame member 12 is provided with a pair of through holes 11*j* corresponding to the recesses 15*b* of the first frame portions 15 and extending in a longitudinal direction. Thus, the through holes 11*j* are disposed on left and right sides of the above-mentioned virtual plane, respectively. In each through hole 11*j*, the operating member 61 is inserted to be rotatable. The operating member 61 has a cylindrical part of a long size extending in the longitudinal direction and, therefore, can be inserted into or removed from the through hole 11*j*.

Each of the partition walls 11*e* has an upper surface provided with a cut portion 11*m* formed at a center position between the first frame portions 15 to receive the end portion of the connection object 31. Each of the second frame portions 17 has an upper surface provided with a cut portion 17*m* formed at a center position between the first frame portions 15 to receive the end portion of the connection object 31. After the header members 13 are mounted on the base board 41, the frame member 12 is fixed to the base board 41.

The connection object 31 has a plurality of positioning protrusions 31*c*. The positioning protrusions 31*c* are inserted into the cut portions 11*m* and 17*m* to properly position the connection object 31.

The terminal portion 21*c* of each contact 21 is soldered and connected to a conductive portion (conductive pad) 41*a* formed on the base board 41 and connected to a circuit on the base board 41. The first and the second frame portions 15 and 17 are fixed to the base board 41 by screws 81 inserted through bottom surfaces of the cut portions 11*m* and 17*m*.

Next, an operation of connecting the connection object 31 to the electrical connector 1 will be described with reference to FIG. 1. In FIG. 1, the contact moving mechanism 50 on the left side of the center line C is at a position in a released state in which the contact 21 is separated from the connection object 31. The contact moving mechanism 50 on the right side of the center line C is at a position in a contacted state in which the connection object 31 and the contact 21 are kept in contact with each other.

The contact spring portion 21*b* has spring characteristics and is displaceable in the first and the second directions A and B. When the operating member 61 is operated to release the pressing force applied by the first cam surface 63*a* to the auxiliary spring member 71 and then to the actuator 51, the actuator 51 is moved in the second direction B under the spring restoring force of the contact spring portion 21*b*. In order to bring the connection object 31 into contact with the contact 21, the operating member 61 is operated to apply the pressing force upon the actuator 51 to move the actuator 51 in the first direction A. When the contact pressing portion 21*b* is pressed in the first direction A, the contact pressing portion 21*b* urges the pressing portion 51*b* by the spring restoring force acting in the second direction B.

In order to connect the connection object 31, the operating member 61 is operated so as to release the pressing force applied upon the actuator 51. Thus, the released state is obtained. In the released state, the end portion of the connection object 31 is inserted between the contacts 21 into the object receiving portion 13*d* until the end portion is butted to the cut portions 11*m* and 17*m*. In this state, a large space is left between a mating contacting portion 31*a* of the connection object 31 and the contact point 21*f* of the contact 21 as shown on the left side of the center line C in FIG. 1.

The butt portion 21*d* of the contact spring portion 21*b* is butted to the pressing portion 51*a* of the actuator 51. The second cam surface 63*b* of the operating member 61 is butted to the deformable plate portion 71*a* of the auxiliary spring member 71. In this state, no pressing force is applied by the operating member 61. The butt portion 21*d* of the contact spring portion 21*b* in a free state is butted to the pressing portion 51*a* to incline the actuator 51 in the second direction B.

In order to move the contact spring portion 21*b* of the contact 21 from the released state and to bring the contact point 21*f* into contact with the mating contacting portion 31*a* of the connection object 31, the operating member 61 is rotated in a clockwise direction as shown on the right side of the center line C in FIG. 1. When the cam portion 63 is rotated sliding along the deformable plate portion 71*a* of the auxiliary spring member 71, the first cam surface 63*a* moves towards the deformable plate portion 71*a* which has been contacted with the second cam surface 63*b* under substantially no pressing force. When the first cam surface 63*a* is brought into contact with the deformable plate portion 71*a*, the deformable plate portion 71*a* is pressed by the first cam surface 63*a* and rotated in the first direction A. Then, the deformable plate portion 71*a* is deformed and contacted with a rear surface 51*f* of the actuator 51 opposite to the pressing portion 51*a*. Consequently, the actuator 51 is rotated in the first direction A around the shaft portion 51*b* located at the bearing portion 13*f*. Then, the pressing portion 51*a* of the actuator 51 presses the butt portion 21*d* of the contact 21 so that the contact point 21*f* is press-contacted with the mating contacting portion 31*a* of the connection object 31.

Since the auxiliary spring member 71 and the contact 21 are simultaneously displaced and deformed, soft and smooth movement is achieved by combinational spring characteristics of the contact 21 and the auxiliary spring member 71, as compared with the case where the auxiliary spring member 71 is not used.

In order to change the contacted state into the released state, the operating member 61 shown on the right side in FIG. 1 is rotated in a counterclockwise direction to move the second cam surface 63*b* towards the deformable plate portion 71*a* which has been contacted with the first cam surface 63*a*. Then, the actuator 51 is rotated in the second direction B around the shaft portion 51*b* located at the bearing portion 13*f*. Then, the pressing portion 51*a* of the actuator 51 no longer presses the butt portion 21*d* of the contact 21 so that the contact point 21*f* is separated from the mating contacting portion 31*a* of the connection object 31 under the spring restoring force of the contact 21.

In order to replace the auxiliary spring member 71, the following operation is carried out. Specifically, the operating member 61 is removed from the insulating housing 11 through the through hole 11*j*. Thereafter, the shaft portion 51*b* of the actuator 51 is disengaged from the bearing portion 13*f* of the header member 13 and the actuator 51 is removed from the insulating housing 11. Then, the auxiliary spring member 71 is replaced by a new one.

Figure 6:
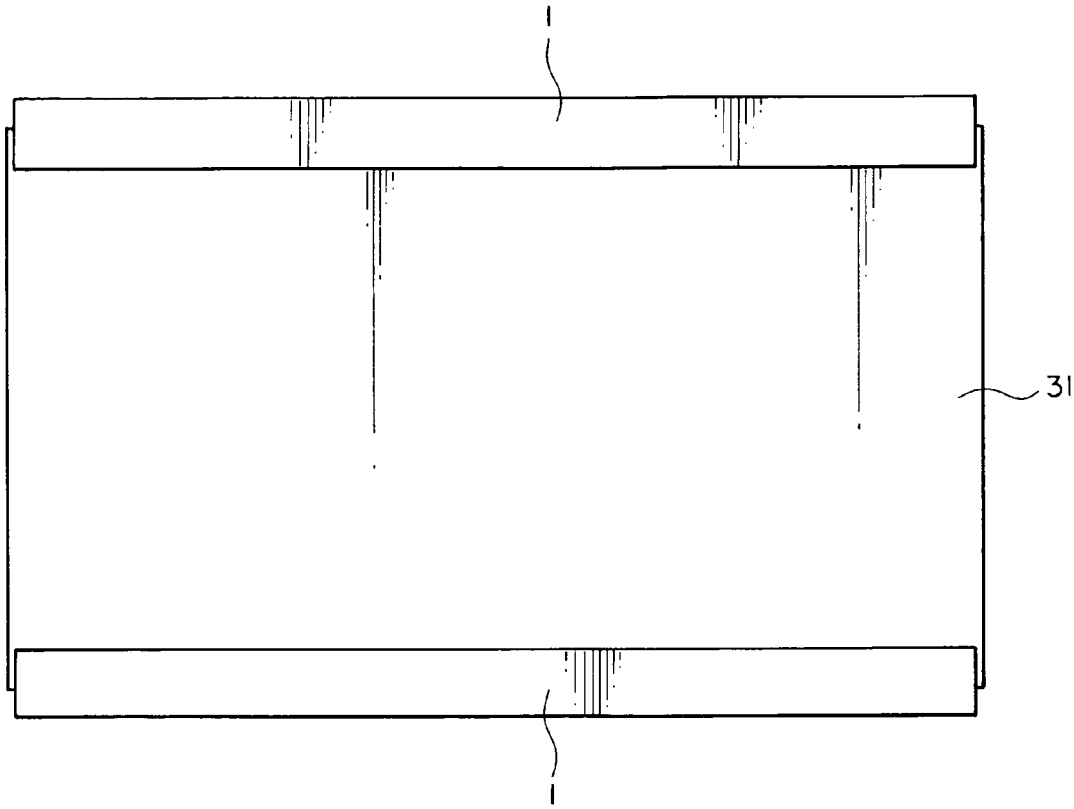
FIG. 6 is a front view showing a state where the electrical connector illustrated in FIG. 1 is attached to each of upper and lower ends of the connection object.
Figure 7:
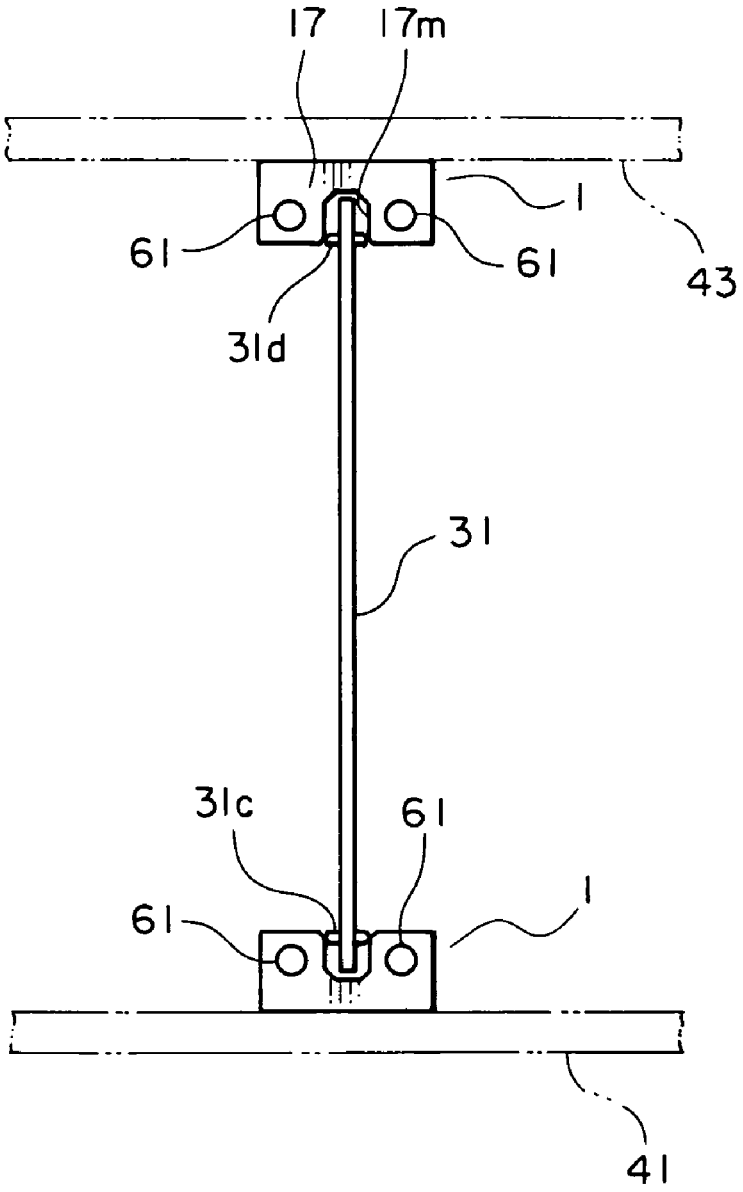
FIG. 7 is a right side view of the electrical connectors and the connection object illustrated in FIG. 6 together with two base boards.

Referring to FIGS. 6 and 7 in addition, description will be made of the case where the connection object 31 is connected to the base board 41 and another base board 43 by the use of two electrical connectors 1.

The electrical connectors 1 are attached to lower and upper ends of the connection object 31, respectively. The lower electrical connector 1 is electrically and mechanically connected to the base board 41 as a mother board. The upper electrical connector 1 is electrically and mechanically connected to the base board 43 as another mother board. As a result, the connection object 31 as a daughter board is substantially perpendicularly arranged with respect to the base boards 41 and 43 as the mother boards.

In the electrical connector 1 mentioned above, the frame member 12 and the header members 13 are formed as separate components. Alternatively, the frame member 12 and the header members 13 may be integrally formed by resin molding. The contacts 21 may be held by the header members 13 during resin molding.

In the above-mentioned electrical connector 1, the auxiliary spring member 71 and the contact 21 are simultaneously displaced and deformed. Therefore, soft and smooth movement is achieved by the combinational spring characteristics of the contact 21 and the auxiliary spring member 71, as compared with the case where the auxiliary spring member 71 is not used. Accordingly, the spring characteristics are improved and the contact reliability is increased.

Since the auxiliary spring member 71 can easily be replaced, desired characteristics are obtained by selecting an appropriate spring as the auxiliary spring member 71.

The actuator 51 for moving the contact 21 between the contacted state and the released state is operated merely by rotating the cam portion 63 of the operating member 61. Thus, the operation of connecting and disconnecting the connection object 31 is easy. In addition, since the movement of the actuator 51 is uniquely determined by the rotation of the cam portion 63, it is easy to maintain the accuracy in moving distance of the actuator 51 and the degree of deformation of the contact 21 and the auxiliary spring member 71.

While this invention has thus far been described in conjunction with the preferred embodiment thereof, it will be readily possible for those skilled in the art to put this invention into practice in various other manners without departing from the scope set forth in the appended claims.

What is claimed is:

1. An electrical connector comprising:

an insulating housing;

a conductive contact held by said housing;

an operating member for applying a pressing force to said contact to bring said contact into contact with a connection object; and an elastic member elastically deformable and interposed between said operating member and said contact, said operating member comprising a first cam surface for applying the pressing force to said contact with elastic deformation of said elastic member; and a second cam surface for releasing the pressing force.

2. An electrical connector comprising:

an insulating housing;

a conductive contact held by said housing;

an operating member for applying a pressing force to said contact to bring said contact into contact with a connection object;

an elastic member elastically deformable and interposed between said operating member and said contact; and an insulating actuator interposed between said contact and said elastic member and adapted to be moved in cooperation with said contact.

3. An electrical connector according to claim 2, wherein said elastic member is a leaf spring member held by said actuator.

4. An electrical connector according to claim 2, wherein said contact has:

a holding portion held by said housing; and a contact spring portion extending from said holding portion and movable and displaceable to be brought into contact with said connection object;

said actuator having a pressing portion kept in contact with said contact spring portion.

5. An electrical connector according to claim 4, wherein said actuator has a shaft portion formed at its one end and pivotally supported on said housing, said pressing portion being formed at a position separated from said shaft portion.

6. An electrical connector according to claim 5, wherein said shaft portion of said actuator is disposed in the vicinity of said holding portion of said contact.

7. An electrical connector according to claim 2, wherein said housing comprises:

a header member; and a frame member surrounding said header member with a space kept therefrom;

said contact and said actuator being held by said header member.

8. An electrical connector according to claim 7, wherein said header member has:

an object receiving portion for receiving at least one end of said connection object; and a contact holding portion holding said contact.

9. An electrical connector according to claim 7, wherein said frame member has a plurality of accommodating chambers aligned in a predetermined direction, said header member being arranged in each of said accommodating chambers.

10. An electrical connector according to claim 9, wherein said operating member passes through said accommodating chambers of said frame member in said predetermined direction.

11. An electrical connector according to claim 7, wherein said frame member has an inner wall surface facing said elastic member, said operating member having a cam portion rotatably held on the inner wall surface of said frame member and kept in sliding contact with said elastic member.

12. An electrical connector according to claim 11, wherein said elastic member has a leaf spring member held by said actuator, said leaf spring member having a deformable plate portion facing said cam portion and a pair of spring holding portions extending from opposite ends of said deformable plate portion and bent and folded back to face said deformable plate portion, said actuator having a pair of spring receiving portions holding said spring holding portions, respectively.

13. An electrical connector according to claim 11, wherein said cam portion has:

a first cam surface as a cylindrical surface; and a second cam surface formed by linearly cutting said first cam surface in directions intersecting with each other;

the inner wall surface of said frame portion having a recess formed in a cylindrical shape to receive said cam portion.

14. An electrical connector comprising:

an insulating housing;

first and second conductive contacts held by said housing;

first and second operating members for applying a pressing force to said first and said second contacts to bring said first and said second contacts into contact with opposite surfaces of a connection object, respectively;

a first elastic member elastically deformable and interposed between said first operating member and said first contact; and a second elastic member elastically deformable and interposed between said second operating member and said second contact;

a first actuator having an insulating characteristic and interposed between said first contact and said first elastic member; and a second actuator having an insulating characteristic and interposed between said second contact and said second elastic member, said first and said second actuators cooperating with said first and said second contacts, respectively.

15. An electrical connector according to claim 14, wherein said housing comprises:

a header member; and a frame member surrounding said header member with a space kept therefrom;

said first and said second contacts being held by said header member.

* * * * *